United States Patent [19]

Von-Meyer

[11] Patent Number: 4,591,403

[45] Date of Patent: May 27, 1986

[54] PAIL LABELING MACHINE

[75] Inventor: Claas Von-Meyer, Hamburg, Fed. Rep. of Germany

[73] Assignee: Anker Labelers Corp., Mt. Laurel, N.J.

[21] Appl. No.: 616,288

[22] Filed: Jun. 1, 1984

[51] Int. Cl.[4] ..... B65C 9/04

[52] U.S. Cl. ..... 156/364; 156/446; 156/458; 156/566; 156/DIG. 26

[58] Field of Search ..... 156/364, 446, 458, 566, 156/567, DIG. 25, DIG. 26

[56] References Cited

U.S. PATENT DOCUMENTS

| | | | |
|---|---|---|---|
| 1,981,278 | 11/1934 | Mudd | 156/566 |
| 2,602,561 | 7/1952 | Carter | 156/458 |
| 2,981,432 | 4/1961 | Flood | 156/566 |
| 3,159,522 | 12/1964 | Schmidt | 156/566 |
| 3,616,092 | 10/1971 | Lavigne | 156/566 |

*Primary Examiner*—Michael Wityshyn
*Attorney, Agent, or Firm*—Duffield & Lehrer

[57] ABSTRACT

A pail labeling machine is disclosed which applies labels to the sides of pails and particularly those having a bail. A continuously moving conveyor is provided which has a loading station, a labeling station and a discharge station. Positioned above the conveyor is a bail guide which maintains the pail bail in an upright position. The bail of the pail is guided in an upright position by the bail guide into a segment of a bail guide carried by a turret of a pail rotation drive mechanism positioned at the labeling station. The pail is arrested in its movement on the conveyor at the labeling station by a pair of rollers which swing into the path of the pail. The bail engaged by the segment of bail guide carried by the turret and rotated by the pail rotation drive mechanism is utilized to rotate the pail as a label is fed from a labeling machine into contact with the side of the pail. The label is in this manner rolled into place upon the side of the pail. Thereafter the pair of rollers are moved out of the path of the pail upon completion of rotation of the pail and the pail permitted to move on the continuously moving conveyor to the discharge station.

6 Claims, 4 Drawing Figures

PAIL LABELING MACHINE

BACKGROUND OF INVENTION

The present invention is concerned with machines for applying labels to containers and, more particularly, to containers of the large pail size utilizing bails.

Various industries which package their products in containers and, particularly, in large containers such as a five gallon pail, have over the years experienced considerable difficulty in applying labels to the exterior walls or surface of the containers. Many of these labels are of sufficient size that they cover much of the height of the container and wrap around the container substantially for its entire circumference.

In the past these labels have been applied by hand which is, of course, very time consuming and costly.

There have been many attempts to automate the application of labels to these large containers. One of the problems encountered in containers of this type is the bail attached to the top of the container. The bail must be maintained in an upright position out of interference with the side of the pail.

One attempt to automate the application of labels was a semi-automatic operation in which the pail was placed upon a manual turn table and the operator essentially applied the label mostly by hand. Another attempt was a rather large and complex machine in which the pail was stationary and the label wrapped around the pail by wiper arms. Such a machine, in addition to being costly at the outset, was also complex and expensive in its maintenance and operation.

What is needed by the industry is an inexpensive, simple but effective machine capable of placing labels on round containers and particularly large containers and, all the more, large containers having bails.

SUMMARY OF INVENTION

The pail labeling machine of the present invention includes a continuously moving conveyor supported upon an appropriate frame structure. The conveyor includes a loading station which moves into a pail labeling station and thereafter to a discharge station.

Positioned above the conveyor and running generally the length of the conveyor is a bail guide which is adjustable both horizontally and vertically such that, when a pail is upon the conveyor, the bail of the pail will fit between the bail guide.

Positioned at the pail labeling station is a pail rotation drive mechanism. The rotation drive mechanism includes a turret that supports a segment of the bail guide. The turret and supported segment of bail guide are adjustable vertically and horizontally to align with the remaining bail guide portions. The pail rotation drive mechanism is adapted to rotate the pail by its bail when actuated.

The labeling station also includes two stop rollers. These stop rollers are mounted upon swing arms and are adapted to be swung into and out of engagement with the pail. When the rollers are swung into stop position, the pail will engage the rollers and be arrested in its movement as the conveyor belt frictionally slides beneath the pail holding the pail against the stop rollers.

A pail labeling machine is also positioned at the labeling station. The pail labeling machine is designed, on appropriate signal, to dispense a glue moistened label which will come into contact with the side of the pail positioned at the labeling station.

The stop rollers are, at the beginning of a labeling sequence, in a position to engage the pail. The pail, upon engaging the stop rollers, initiates a sequence control circuit which will signal the pail rotation drive mechanism to rotate the turret and thus the pail by means of its bail. Upon appropriate electrical signal from the sequence control circuit, the pail labeling machine will dispense a label into contact with the side of the pail. As the pail continues to rotate, the label adheres to the side of the pail and will be drawn from the pail labeling machine and passed under the stop rollers and be adhered to the side of the pail.

Upon the pail making a full 360 degrees of rotation, the sequence control circuit will sense the realignment of the segment of the bail guide carried by the turret and the stop rollers will be withdrawn and the labeled pail permitted to continue along the conveyor. The stop rollers are then set back into the stop position upon passage of the pail and the sequence repeated with the next advancing pail.

DESCRIPTION OF INVENTION

Figure 1:
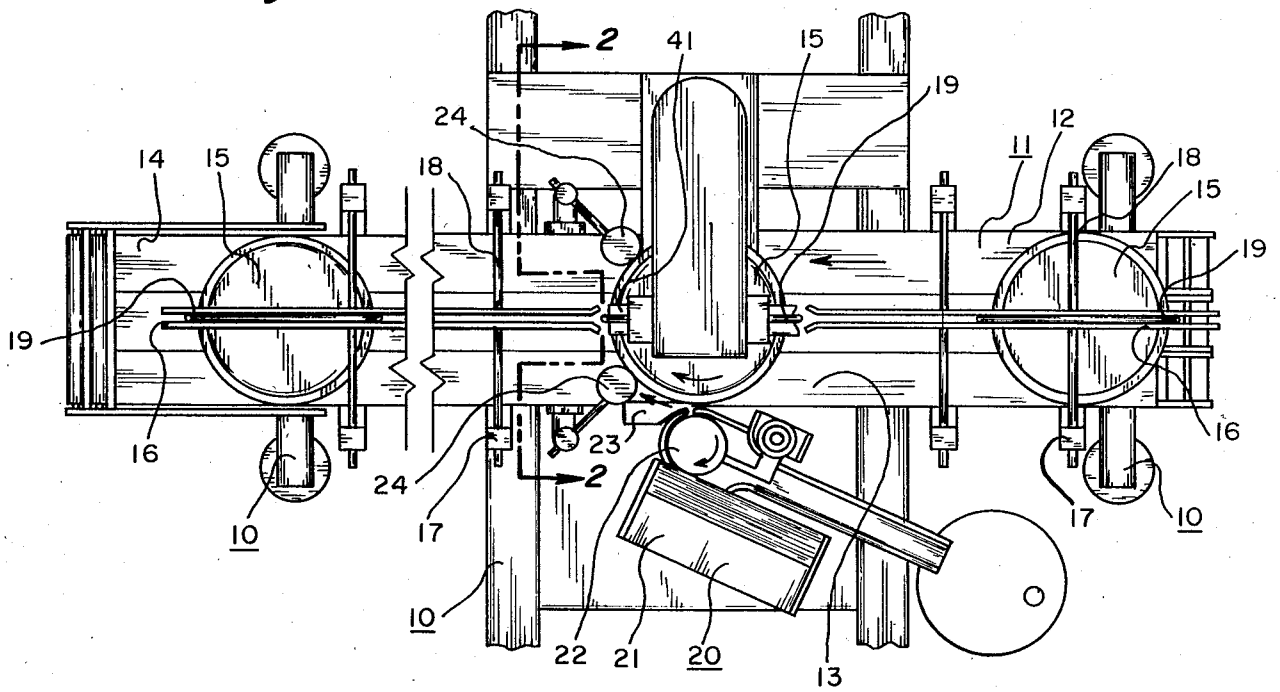
FIG. 1 is a plan view of the pail labeling machine of the present invention.

The pail labeling machine of the present invention is shown in detail in FIGS. 1–4 of the drawings. The pail labeling machine includes a suitable frame structure 10 which supports a conveyor 11. The conveyor is driven by a conveyor motor (not shown) and operates in a conventional manner. The conveyor includes a loading station 12 which progresses to a labeling station 13 and on thereafter to a discharge station 14. The conveyor is adapted to convey a pail 15 to be labeled from the loading station 12 to the labeling station 13 and, after labeling, to the discharge station 14.

Positioned above and generally centrally of the conveyor at the loading station 12 and discharge station 14 are two bail guides 16 formed of pairs of parallel rails.

The bail guides 16 are supported upon a plurality of vertical uprights 17 and interconnected horizontal crossmembers 18. By means of appropriate threaded clamping members, the horizontal crossmembers 18 may be adjusted vertically and horizontally to position the bail guides 16 above the conveyor. When appropriately adjusted, the bail 19 of a pail 15 may be fitted in an upright position just beneath the bail guide. In this manner, the bail 19 of the pail 15 is maintained in an upright position and out of interference with the sides of the pail 15 for purposes to be described hereinafter.

A pail labeling machine 20 is positioned at the pail labeling station 13. The pail labeling machine 20 is of a conventional nature and employs a label dispenser 21, a glue roller 22 and a scraper comb 23. The pail labeling machine 20 operates, upon appropriate command, to dispense a label which passes through the glue roller 22 and scraper comb 23 into engagement with the side edge of the pail 15 to be labeled.

A pair of stop rollers 24 are positioned at the pail labeling station 13. As may best be seen in FIGS. 3 and 4 of the drawings, the stop rollers 24 are carried by upper and lower swing arms 26 and 27 respectively. The upper and lower swing arms 26 and 27 respectively, are carried by upper and lower pivot arms 28 and 29 respectively, which, in turn, are connected by means of an axle 30 through a supporting bracket 46.

A pneumatic cyclinder 31 is connected to the lower end of the axle 30. In operation, upon actuation of the pneumatic cyclinder 31, the stop rollers 24 will be swung into and out of the path of a pail 15 moving on the conveyor 11.

Figure 2:
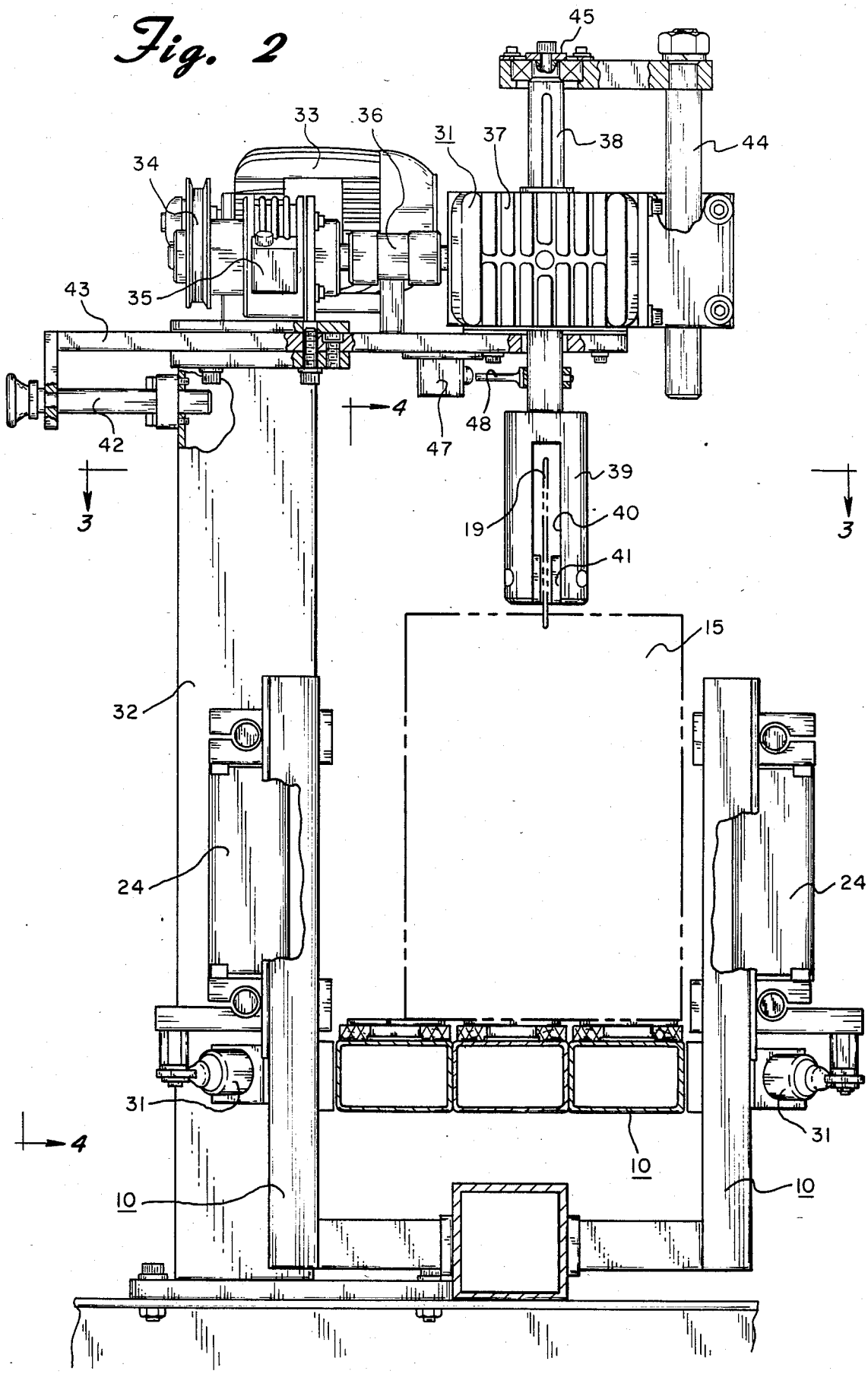
FIG. 2 is a left end elevational view of the pail labeler of the present invention.
Figure 3:
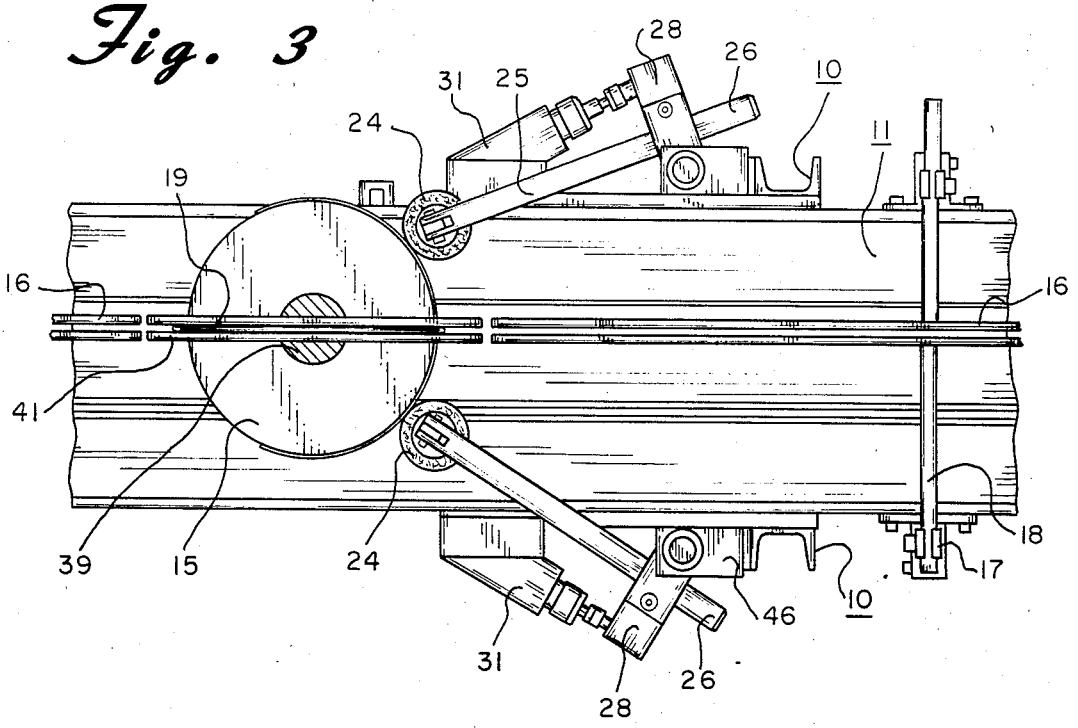
FIG. 3 is a plan view through the section line 3—3 of FIG. 2.
Figure 4:
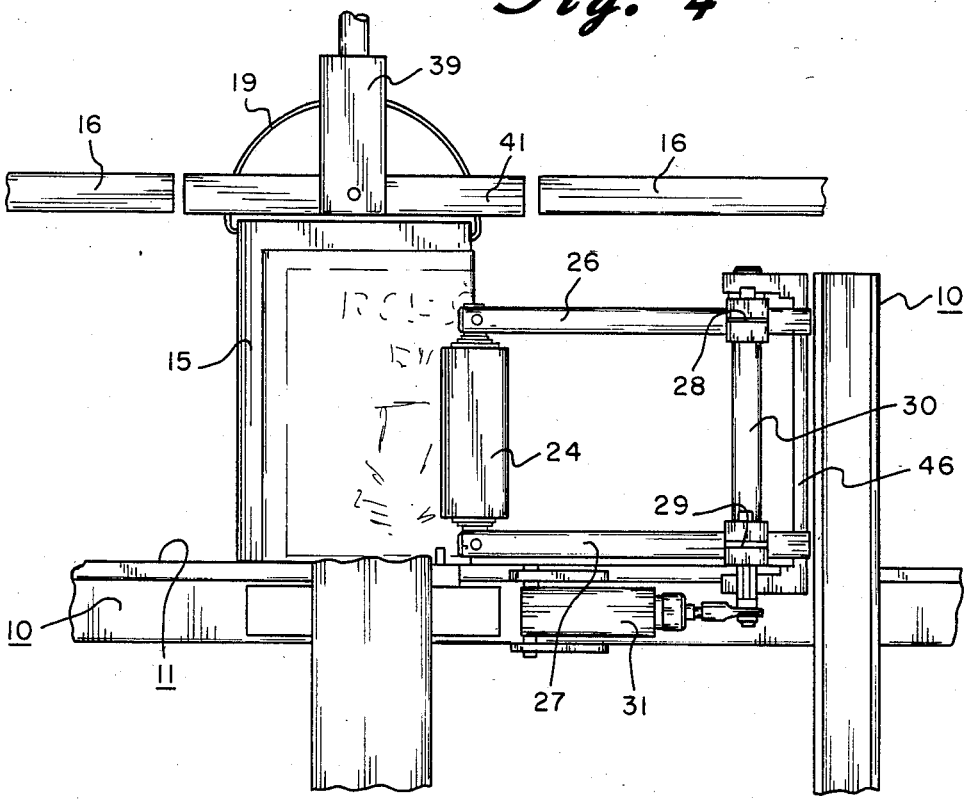
FIG. 4 is a partial sectional view through the line 4—4 of the FIG. 2.

As may best be seen in FIG. 2 of the drawings, a pail rotation drive mechanism 31 is positioned at the pail labeling station 13 above the conveyor 11. The pail rotation drive mechanism is supported in position above the conveyor 11 on a support plate 43 carried by a vertical column 32.

The pail rotation drive mechanism 31 includes an electric drive motor 33 which, by means of a V-belt arrangement 34, drives a clutch mechanism 35. The clutch mechanism 35, in turn, through a coupling 36 operates a gear reduction unit 37.

The output of the gear reduction unit 37, by means of a vertically variable spindle 38, drives a turret 39. The turret includes a slot 40 therein. In the lower portion of the slot 40 is secured a segment of bail guide 41. As may best be seen in FIG. 4, the segment of bail guide 41 is of length just to slightly clear either of the inner edges of the bail guide 16 when rotated into aligned position.

The entire pail rotation drive mechanism is adjustable both vertically and horizontally. A threaded adjusting screw 42 moves the mounting plate 43 in a horizontal direction to adjust the horizontal position of the turret 39.

A vertical supporting rod 44 carried by the gear reduction unit 37 can be adjusted vertically to raise and lower the vertically variable spindle 38 through a thrust bearing 45 to appropriately position the level vertically of the turret 39. In this manner, the pail rotation drive mechanism may be adjusted both vertically and horizontally to accommodate differing diameters and heights of pails.

The operation of the pail labeling machine of the present invention is controlled by a sequence control circuit (not shown). The sequence control circuit includes a microswitch 47 carried by the mounting plate 43 and a microswitch actuator 48 carried by the spindle 38 for actuation of the microswitch 47. Additionally, the stop rollers include a pressure sensitive microswitch combination which is actuated upon a pail abutting the pressure rollers when they are in their inward position above the conveyor 11. Further, a variable time delay circuit is provided and interconnected with the pail labeling machine to variably set the time at which the pail labeling machine will dispense a label in connection with the angular position of the pail.

In operation, the conveyor belt is continuously running. A pail to be labeled is placed upon the conveyor at the loading station with the bail of the pail positioned within the bail guide. At this point the stop rollers have been moved into closed position above the conveyor by operation of the sequence control circuit. Additionally, the pail rotation drive mechanism has indexed to a point where the segment of rail guide carried by the turret is in alignment with the bail guide of the loading and discharge stations.

The pail will progress along the conveyor and into engagement with the stop rollers with its bail within the segment of bail guide. Upon engagement of the pail with the stop rollers, the microswitch associated with the stop rollers will be actuated indicating the presence at the pail labeling station of a pail. The sequence control circuit then initiates engagement of the clutch mechanism of the pail rotation drive mechanism and the pail rotation drive mechanism then begins to rotate the pail by means of its bail. The pail at this point is being held into engagement with the stop rollers by means of the friction of the conveyor belt moving beneath the pail.

After a prescribed time as set in the time delay relay, the pail labeling mechanism will dispense a label which will have an appropriate amount of glue thereon. The label will be dispensed in a manner such that its leading edge will come into contact with the rotating pail and be carried by the adhesive contact of the label with the pail as the pail continues to rotate. The label so rotating with the pail will pass between the stop rollers and the pail and be further pressed into contact with the sides of the bail. The amount of time delay set into the time delay relay can be variably adjusted to compensate for differing circumferential lengths of labels in order to position the labels in respect to the pails at desired positions around the circumference of the pail.

The pail will continue its rotation until it has reached a full rotation of 360 degrees. At this point the microswitch and actuator carried by the mounting plate and turret respectively will engage and signal the sequence control circuitry to disengage the clutch mechanism. As this occurs, the pail will cease its rotation. Additionally, the signal from the microswitch will signal the sequence control circuitry to pull the stop rollers out of engagement with the pail by means of the operation of the pneumatic cylinders. As this occurs, the pail will now move with the conveyor and the bail of the pail will move into alignment with the bail guide of the discharge station and move on to the discharge station.

Once the pail has cleared the stop rollers in its travel toward the discharge station, the sequence control circuitry will return the stop rollers back to their stop position above the conveyor and the sequence will repeat itself upon arrival of the next pail.

By way of illustration and not limitation, the pail labeling machine of the present invention is capable of labeling up to 35 containers per minute. Labels up to 25 inches in length may be applied. The conveyor speed is in the range of up to 50 feet per minute.

The pail labeling machine of the present invention has been described in respect to a particular embodiment thereof. However, it is to be understood that those skilled in the art may practice the invention by means of variations other than those shown in the particular embodiment disclosed. Accordingly, the scope of the invention is not to be interpreted in view of the particular embodiment shown but is to be interpreted in view of the appended claims.

What is claimed is:

1. A pail labeling machine for applying labels to sides of pails having a bail and the like comprising:

conveyor means for conveying the pail to be labeled from a loading station to and past a labeling station to a discharge station;

pail stop means located at the labeling station for selectively arresting the pail's movement by the conveyor means;

pail rotation means positioned at the labeling station for engaging the bail for rotating the pail through a predetermined degree of rotation; and pail labeling means positioned at the labeling station for dispensing a label into contact with the side of the pail in predetermined time relationship with the operation of the pail rotation means.

2. The pail labeling machine of claim 1 further including a bail guide means positioned above the conveyor means to provide a guide for and transition of the pail bail from the loading station into and from the pail rotation means to the discharge station.

3. The pail labeling machine of claim 1 wherein the pail stop means includes roller means which move into and out of the path of the pail as it is moved by the conveyor means.

4. The pail labeling machine of claim 1 further including sequence control means operable upon the pail reaching the pail stop means to actuate the pail rotation means and pail labeling means and upon the pail rotation means completing its predetermined degree of rotation then releasing the pail for movement by the conveyor means.

5. The pail labeling machine of claim 4 wherein the conveyor means is continuously operating.

6. The pail rotation means of claim 4 wherein the pail rotation means rotates the pail 360 degrees.

* * * * *